United States Patent [19]

Rastogi

[11] Patent Number: 4,529,453

[45] Date of Patent: Jul. 16, 1985

[54] MEDIUM SILICON STEEL ELECTRICAL LAMINATION STRIP

[75] Inventor: Prahbat K. Rastogi, Munster, Ind.

[73] Assignee: Inland Steel Company, Chicago, Ill.

[21] Appl. No.: 439,883

[22] Filed: Nov. 8, 1982

Related U.S. Application Data

[62] Division of Ser. No. 279,829, Jul. 2, 1981, Pat. No. 4,390,378.

[51] Int. Cl.[3] ..... H01F 1/04

[52] U.S. Cl. ..... 148/31.55; 75/123 L; 75/124

[58] Field of Search ..... 148/31.55; 75/123 L, 75/124 R, 124 B, 124 C, 124 E, 124 F

[56] References Cited

U.S. PATENT DOCUMENTS

| | | | |
|---|---|---|---|
| 2,287,467 | 6/1942 | Carpenter et al. | 148/12 |
| 2,303,343 | 12/1942 | Engel et al. | 148/12 |
| 3,180,767 | 4/1965 | Easton et al. | 148/120 |
| 3,188,250 | 6/1965 | Holbein et al. | 148/120 |
| 3,855,021 | 12/1974 | Salsgiver et al. | 148/112 |
| 3,867,211 | 2/1975 | Easton | 148/31.55 |
| 3,933,537 | 1/1976 | Imanaka et al. | 148/112 |
| 3,948,691 | 4/1976 | Matsushita et al. | 148/112 |
| 3,960,616 | 7/1976 | Evans et al. | 148/111 |
| 3,971,678 | 7/1976 | Vlad | 148/111 |
| 4,204,890 | 5/1980 | Irie et al. | 148/111 |
| 4,293,336 | 10/1981 | Matsumura et al. | 75/124 |
| 4,306,922 | 12/1981 | Coombs et al. | 148/111 |

*Primary Examiner*—John P. Sheehan

*Attorney, Agent, or Firm*—Marshall, O'Toole, Gerstein, Murray & Bicknell

[57] ABSTRACT

The chemical composition and processing of a cold rolled steel strip are controlled. Laminations for the core of an electric motor are stamped from the strip and decarburized to produce a lamination having a 1.5 T (15 kG) average core loss value less than about 5.1 W/kg (2.30 W/lb.) and average peak permeability more than about 1800 G/Oe. for a sample thickness of about 0.018 in. (0.46 mm.).

1 Claim, No Drawings

MEDIUM SILICON STEEL ELECTRICAL LAMINATION STRIP

This is a division of application Ser. No. 279,829, filed July 2, 1981, now U.S. Pat. No. 4,390,378.

BACKGROUND OF THE INVENTION

The present invention relates generally to cold rolled steel strip from which is made the core of an electric motor, and more particularly to steel strip which imparts to the core a relatively low core loss and a comparatively high peak permeability.

An electric motor is composed of a stator surrounding a rotor. The stator is composed of wire made from a relatively high conductivity material, such as copper, wound on a core composed of steel. The steel core of an electric motor is made up of laminations fabricated from cold rolled steel strip, typically composed of a silicon-containing steel, and the steel laminations impart to the core properties known as core loss and peak permeability which affect the power loss in the motor. Core loss, as the name implies, reflects power loss in the core. Peak permeability reflects power loss in the winding around the core. Core loss is expressed as watts per pound (W/lb.) or watts per kilogram (W/kg.). Peak permeability is expressed as Gauss per Oersted (G/Oe). Permeability may also be described in terms of relative permeability in which case it is expressed without units although the numbers would be the same as the numbers for the corresponding peak permeability. Core loss and peak permeability are both measured for the magnetic induction at which the core is intended to operate. Magnetic induction is expressed as Tesla (T) or kilo-Gauss (kG). A typical magnetic induction is 1.5 T (15 kG).

Thus, core loss reflects the power loss due to the core at a given magnetic induction, e.g., 1.5 T (15 kG), and peak permeability reflects the magnetizing current in the material of the core at that given induction. The higher the peak permeability, the lower the magnetizing current needed to achieve a given induction. In addition, the higher the peak permeability for a given induction, the lower the power loss in the winding. Winding loss plus core loss are both important factors which reduce the efficiency of the motor.

Core loss and peak permeability are inherent properties of the steel strip from which the core laminations are fabricated. Therefore, an aim in producing steel strip for use in making the core of an electric motor is to reduce the core loss and increase the peak permeability of that steel strip, both of which factors increase the efficiency of the motor. Both of these factors are affected by the composition and heat treatment of the strip.

Moreover, for a steel having a given composition and heat treatment, core loss increases with an increase in the thickness of the strip rolled from that steel. Thus, comparisons of core loss should be made on steel strips having comparable thicknesses. For example, assuming a core loss of 5.10 W/kg (2.30 W/lb.) at a strip thickness of 0.018 inches (0.46 mm.), if there is then an increase in thickness of 0.001 inch (0.0254 mm.), the core loss will increase typically at an estimated rate of about 0.22 W/kg (0.10 W/lb.).

SUMMARY OF THE INVENTION

It is the aim of the present invention to produce a cold-rolled steel strip for use in electric motor core laminations having a 1.5 T (15 kG) average core loss value less than about 5.1 W/kg (2.30 W/lb.) and average peak permeability more than about 1,800 G/Oe. for a sample thickness of about 0.018 inch (0.46 mm). This is accomplished by utilizing a combination of steel chemistry and steel processing techniques, to be described below. Generally, the steel composition includes 0.85–1.05 wt.% silicon and 0.20–0.30 wt.% aluminum. The carbon content is about 0.05 wt.% max. However, if a decarburizing anneal is performed after the steel is hot-rolled into strip but before the steel strip is cold-rolled, a carbon content of up to 0.09 wt.% can be utilized initially in the steel melt before it is cast and rolled. The molten steel may be either ingot cast or continuously cast, and both should provide the desired properties.

The cast steel is then hot-rolled employing essentially conventional hot-rolling techniques, although the temperature at which the hot-rolled steel strip is coiled must be controlled within a temperature range of 1250°–1400° F. (682°–760° C.). After the hot-rolled steel strip has cooled, it is cold-rolled and then continuously annealed. A batch annealing process will not give the desired peak permeability.

After continuous annealing, the cold-rolled steel strip is temper-rolled and then shipped, in that condition, without decarburizing, to the customer, who stamps out the individual laminations from the steel strip and then subjects the laminations to a decarburizing or magnetic anneal to reduce the carbon content of the steel, e.g., to less than about 0.006 wt.%. The decarburizing anneal is performed by the customer rather than the steelmaker because, after the steel has been decarburized, it is not always readily susceptible to a stamping operation. Accordingly, the stamping operation is usually performed before the decarburizing anneal, and because it is the customer who performs the stamping operation, it is also the customer who usually performs the subsequent decarburizing anneal.

Because of the chemistry of the steel and the processing to which the cold rolled steel strip was subjected before it was shipped to the customer, there is present in the steel strip, as shipped to the customer, a grain size and crystallographic orientation which, upon subsequent magnetic annealing under controlled time and temperature conditions in a decarburizing atmosphere, produces an average ferritic grain size of about 3.5–5.0 ASTM and a preponderance of crystallographic planes containing the easiest direction of magnetization. Crystallographic planes containing the easiest direction of magnetization, i.e., <001>, include planes such as {200} and {220}. An example of a crystallographic plane which does not contain the easiest direction of magnetization is a {222} plane.

In the expression "preponderance of planes containing the easiest direction of magnetization," the word "preponderance" means that there are more of this type of plane (e.g., {200} and {220}) than of any other type (e.g., {222}). The expression recited in the preceding sentence is one way of defining a steel having a relatively improved magnetic texture. Another way of defining an improved magnetic texture is to say that the steel has primarily a high fraction of {200} and {220} planes and a low fraction of (222) planes.

A cold rolled steel strip in accordance with the present invention may also be used as the material from which is fabricated cores for small transformers.

Other features and advantages are inherent in the methods and products claimed and disclosed or will become apparent to those skilled in the art from the following detailed description.

DETAILED DESCRIPTION

In accordance with an embodiment of the present invention, there is provided a steel having substantially the following initial chemistry, in weight percent.

| Element | Permissible Range | Preferable Range |
|---|---|---|
| Carbon | .05 max. | .04 max. |
| Manganese | .50–.70 | .55–.65 |
| Silicon | .85–1.05 | .90–1.00 |
| Aluminum | .20–.30 | .20–.25 |
| Phosphorus | .08 max. | .05 max. |
| Sulfur | .02 max. | .02 max. |
| Iron | Essentially the balance | Essentially the balance |

Molten steel having a chemistry within the ranges set forth above is then ingot cast, and the solidified steel is then subjected to a conventional hot-rolling procedure up to the coiling step. Coiling should be performed at a coiling temperature within the permissable range 1250°–1400° F. (682°–760° C.). Preferably, coiling is performed at a temperature in the range 1300°–1350° F. (704°–732° C.).

After coiling, the strip is allowed to cool and then is subjected to a cold-rolling procedure. During cold-rolling, the strip is subjected to a reduction of about 65–80% (70–75% preferred), and the strip is cold-rolled down to a thickness of about 0.018–0.025 inches (0.45–0.65 mm), for example.

Where the steel has an initial carbon content of 0.05 wt.% max., there is no need for a decarburization anneal between the hot-rolling and cold-rolling steps. However, the steel may be provided with an initial carbon content up to 0.09 wt.% max. if a decarburizing step is performed after the hot-rolling step and before the cold-rolling step. This decarburizing step may employ conventional time, temperature and atmospheric conditions, and it reduces the carbon content from 0.09 wt.% max. down to about 0.05 wt.% max.

After cold-rolling, the cold-rolled steel strip is subjected to a continuous annealing step in which the steel strip is at a strip temperature in the range 1250°–1400° F. (682°–760° C.) for about 2–5 minutes, following which the strip is cooled. Preferably, the steel strip is continuously annealed at a strip temperature in the range 1300°–1400° F. (704°–788° C.) for about 2.5–3.5 minutes. Batch annealing should be avoided because batch annealing does not provide the desired peak permeability.

After the strip has cooled following continuous annealing, the strip is subjected to temper-rolling to produce a reduction of about 6–8.5% (preferably 6.5–7.5%). After temper-rolling, the steel strip is usually shipped to the customer for fabrication into core laminations.

As shipped to the customer, the steel strip has a microstructure consisting essentially of ferrite plus carbides. This assumes, of course, a carbon content (e.g., greater than 0.008 wt.%) which will produce carbide precipitates in the microstructure. Where the carbon content is very low, there will be no carbide precipitates in the microstructure. The microstructure also has an average ferritic grain size in the range 9.5–11.0 ASTM.

As shipped to the customer, the steel strip has a grain size (noted above) and crystallographic orientation which, upon subsequent magnetic annealing (under conditions to be described below), produces an average ferritic grain size of about 4–5.0 ASTM and a preponderance of crystallographic planes containing the easiest direction of magnetization.

After receiving the steel strip, the customer will stamp out the individual electric motor core laminations from the steel strip and then subject the laminations to magnetic or decarburization annealing at a temperature in the range 1400°–1550° F. (760°–843° C.) for about 1–2 hours in a conventional decarburizing atmosphere. This will reduce the carbon content to less than about 0.006 wt.% and produce an average ferritic grain size of about 4–5.0 ASTM and a preponderance of crystallographic planes containing the easiest direction of magnetization. Preferably, the magnetic annealing step is conducted at a temperature substantially below 1550° F. (843° C.), e.g., 1425°–1500° F. (774°–816° C.).

Following the magnetic or decarburizing anneal described above, the steel will have a 1.5 T (15 kG) average core loss value less than about 5.1 W/kg (2.3 W/lb.) and average peak permeability more than about 1,800 G/Oe. for a sample thickness of about 0.018 inches (0.46 mm). The magnetic properties described in the preceding sentence and elsewhere herein are based on a standard ASTM test using so-called Epstein packs containing an equal number of longitudinal and transverse samples of the decarburized steel used in said laminations and having a size of 28 cm×3 cm. (11.02 in. x. 1.18 in.).

As noted above, the steel, after the decarburizing anneal, includes a preponderance of crystallographic planes containing the easiest direction of magnetization, i.e., planes identified as {200}, {220}, {310} and {420}, as distinguished from planes having a crystallographic orientation which do not contain the easiest direction of magnetization, such as planes known as {211}, {222}, {321} and {332}.

As also noted above, increased peak permeability is a desirable property for a core lamination. Peak permeability increases with an increase in magnetic texture, and magnetic texture increases with an increase in the number of planes containing the easiest direction of magnetization, e.g., {200}, {220}, {310} and {420}. On the other hand, magnetic texture decreases with an increase in the number of planes which do not contain the easiest direction of magnetization, e.g., {211}, {222}, {321} and {332}.

Referring now to a typical example of a steel strip having core loss and peak permeability values in accordance with the present invention, such a strip was produced with an initial chemical composition consisting essentially of, in weight percent:

| | |
|---|---|
| carbon | 0.04 |
| manganese | 0.55 |
| silicon | 0.96 |
| aluminum | 0.22 |
| phosphorus | 0.07 |
| sulfur | 0.020 |
| iron | essentially the balance |

Typical examples of hot-rolling, continuous annealing and temper-rolling procedures for an ingot cast steel in accordance with the present invention are set forth below in the following table.

| | Hot Rolling | | | | | | | | Continuous Annealing C/A | | | |
|---|---|---|---|---|---|---|---|---|---|---|---|---|
| | Hot Band | Finishing Temperatures | | | Coiling Temperatures | | | | Heat | Hold | Hardness | Temper |
| Coil | Guage (in.) | Hi (°F.) | Low (°F.) | Avg. (°F.) | Hi (°F.) | Low (°F.) | Avg. (°F.) | Line Speed (Ft/Min.) | Zone Strip Temp. (°F.) | Zone Strip Temp. (°F.) | After C/A (Rb) | Rolling Elong. % |
| A | .080 | 1680 | 1640 | 1650 | 1330 | 1280 | 1300 | 275 | 1390 | 1380 | 74 | 8.0 |
| B | " | 1630 | 1590 | 1610 | 1300 | 1250 | 1280 | 275 | 1395 | 1385 | N/A | 7.5 |
| C | " | 1640 | 1610 | 1630 | 1300 | 1270 | 1290 | 275 | 1390 | 1385 | 72 | 8.0 |
| D | " | 1650 | 1620 | 1635 | 1320 | 1260 | 1290 | 275 | 1400 | 1385 | N/A | 8.5 |
| E | " | 1630 | 1620 | 1635 | 1320 | 1250 | 1275 | 300 | 1390 | 1380 | 71 | 8.5 |
| F | " | 1670 | 1650 | 1660 | 1320 | 1290 | 1310 | 275 | 1395 | 1385 | 69 | 8.5 |
| G | " | 1600 | 1560 | 1580 | 1280 | 1250 | 1270 | 275 | 1380 | 1380 | 71 | 8.0 |
| H | " | 1620 | 1580 | 1590 | 1300 | 1250 | 1270 | 275 | 1380 | 1375 | 70 | 8.5 |
| I | " | 1670 | 1600 | 1650 | 1320 | 1260 | 1300 | 275 | 1390 | 1380 | 70 | 8.5 |
| J | " | 1620 | 1570 | 1590 | 1300 | 1250 | 1280 | 275 | 1400 | 1395 | 72 | 8.5 |
| K | " | 1630 | 1610 | 1620 | 1300 | 1250 | 1280 | 275 | 1395 | 1355 | 75 | 8.5 |
| L | " | 1610 | 1570 | 1590 | 1300 | 1250 | 1275 | 275 | 1385 | 1355 | 74 | 8.5 |
| M | " | 1670 | 1620 | 1650 | 1330 | 1250 | 1300 | 275 | 1400 | 1355 | 73 | 8.5 |
| N | .090 | 1690 | 1650 | 1670 | 1350 | 1290 | 1300 | 275 | 1380 | 1380 | 76 | 8.5 |
| O | " | 1690 | 1650 | 1670 | 1360 | 1300 | 1330 | 260 | 1385 | 1380 | 74 | 8.5 |
| P | " | 1680 | 1650 | 1670 | 1350 | 1300 | 1320 | 275 | 1380 | 1380 | 72 | 8.5 |
| Q | " | 1680 | 1650 | 1670 | 1350 | 1300 | 1320 | 275 | 1390 | 1380 | 72 | 8.5 |
| R | " | 1670 | 1650 | 1660 | 1350 | 1300 | 1320 | 275 | 1390 | 1380 | 74 | 8.5 |

Magnetic characteristics at 1.5 T (15 kG) and other characteristics of steel strip subjected to the processing set forth in the preceding table are given below in the following table. Each coil was tested at its head and tail, and the tests are listed in that order.

| | 15 kG Core Loss | Peak Permeability (G/Oe.) at: | | | ASTM Grain | Thickness |
|---|---|---|---|---|---|---|
| Coil | (W/lb.) | 15 kG | 17 kG | 18 kG | Size | (in.) |
| A | 2.22 | 1947 | 341 | 185 | 4.3 | 0.0185 |
| | 2.20 | 1906 | 349 | 194 | | 0.0185 |
| B | 2.34 | 1754 | 334 | 185 | 4.6 | 0.0185 |
| | 2.27 | 1967 | 351 | 194 | | 0.0195 |
| C | 2.21 | 1961 | 329 | 184 | | 0.0180 |
| | 2.11 | 1978 | 346 | 190 | | 0.0185 |
| D | 2.12 | 1943 | 345 | 185 | | 0.0180 |
| | 2.14 | 2041 | 350 | 191 | | 0.0185 |
| E | 2.19 | 1824 | 351 | 190 | | 0.017 |
| | 2.14 | 1996 | 356 | 194 | | 0.018 |
| F | 2.20 | 1791 | 329 | 184 | | 0.0175 |
| | 2.12 | 2167 | 350 | 191 | | 0.0175 |
| G | 2.30 | 1931 | 350 | 190 | 4.5 | 0.0195 |
| | 2.04 | 1907 | 345 | 189 | | 0.017 |
| H | 2.25 | 1671 | 320 | 179 | | 0.018 |
| | 2.16 | 1964 | 345 | 186 | | 0.0185 |
| I | 2.31 | 1722 | 327 | 182 | 4.4 | 0.0175 |
| | 2.07 | 2172 | 366 | 197 | | 0.018 |
| J | 2.29 | 1752 | 345 | 191 | | 0.0175 |
| | 2.21 | 2022 | 366 | 197 | | 0.0185 |
| K | 2.60 | 1768 | 342 | 188 | 4.7 | 0.0225 |
| | 2.47 | 1842 | 351 | 194 | | 0.0210 |
| L | 2.43 | 1964 | 338 | 185 | | 0.0215 |
| | 2.44 | 2020 | 351 | 194 | | 0.0215 |
| M | 2.48 | 1875 | 349 | 190 | 4.4 | 0.0215 |
| | 2.42 | 2178 | 356 | 194 | | 0.022 |
| N | 2.86 | 1577 | 340 | 188 | | 0.0245 |
| | 2.74 | 1815 | 340 | 186 | | 0.0240 |
| O | 2.80 | 1893 | 337 | 186 | 4.9 | 0.0255 |
| | 2.48 | 2110 | 359 | 193 | 5.0 | 0.0235 |
| P | 2.63 | 2090 | 349 | 189 | | 0.0240 |
| | 2.43 | 2179 | 360 | 193 | | 0.0225 |
| Q | 2.84 | 1610 | 334 | 183 | | 0.0245 |
| | 2.59 | 2043 | 352 | 191 | | 0.0235 |
| R | 2.67 | 1954 | 341 | 185 | 4.6 | 0.0245 |
| | 2.63 | 2042 | 356 | 194 | | 0.024 |

The variation in the magnetic properties of the strip with variations in thickness are reflected in the following table. The values in parenthesis indicate the spread in product properties.

| Thickness (in.) | No. of Tests | Average Core Loss (W/lb.) | Average Peak Permeability (G/Oe.) at 15 kG | 17 kG | 18 kG |
|---|---|---|---|---|---|
| 0.0181 (0.017/0.0195) | 20 | 2.19 (2.04/2.34) | 1921 (1671/2172) | 345 (320/366) | 189 (179/197) |
| 0.0217 (0.021/0.0225) | 6 | 2.47 (2.42/2.60) | 1941 (1768/2178) | 348 (338/356) | 191 (185/194) |
| 0.0241 (0.0235/ | 10 | 2.67 (2.43/2.86) | 1931 (1577/2179) | 347 (334/360) | 189 (183/194) |

The foregoing detailed description has been given for clearness of understanding only and no unnecessary limitations should be understood therefrom as modifications will be obvious to those skilled in the art.

I claim:

1. An electric motor lamination comprising:

a steel composition consisting essentially of, in wt.%:

| | |
|---|---|
| carbon | .006 max. |
| manganese | .50–.70 |
| silicon | .85–1.05 |
| aluminum | .20–.30 |
| phosphorus | .08 max. |
| sulfur | .02 max. |
| iron | essentially the balance; |

a microstructure consisting essentially of ferrite grains with an average ferritic grain size of about 4.0–5.0 ASTM;

a preponderance of crystallographic planes containing the easiest direction of magnetization;

and a 1.5 T (15 kG) average core loss value less than about 5.1 W/kg (2.3 W/lb.) and average peak permeability more than about 1,800 G/Oe. for a thickness of about 0.018 in. (0.46 mm.).

* * * * *